United States Patent [19]

Lassman et al.

[11] 4,141,394

[45] Feb. 27, 1979

[54] APPARATUS FOR PREVENTING AN UNCONTROLLED EMISSION OF GASEOUS HYDROCARBONS DURING THE FILLING OF CONTAINERS

[75] Inventors: Josef Lassman, Oberursel; Herbert Nuglisch, Bremthal am Konigsberg, both of Fed. Rep. of Germany

[73] Assignee: Edeleanu Gesellschaft mbH, Frankfurt, Fed. Rep. of Germany

[21] Appl. No.: 831,571

[22] Filed: Sep. 8, 1977

Related U.S. Application Data

[63] Continuation-in-part of Ser. No. 643,898, Dec. 23, 1975, abandoned.

[30] Foreign Application Priority Data

Jul. 1, 1975 [DE] Fed. Rep. of Germany ..... 2529218

[51] Int. Cl.[2] ..... B67C 3/34

[52] U.S. Cl. ..... 141/284; 141/286

[58] Field of Search ..... 137/592, 312; 141/59, 141/93, 284, 85-87, 115, 231-233, 292, 295, 311 A, 374, 392, 4-7, 258-262, 1, 48, 286; 214/18 PH; 222/379, 398, 523; 193/30

[56] References Cited

U.S. PATENT DOCUMENTS

| | | | |
|---|---|---|---|
| 2,874,734 | 2/1959 | Luckock et al. | 141/87 |
| 3,867,969 | 2/1975 | Garnett | 141/59 |
| 3,872,899 | 3/1975 | Knight | 141/59 |
| 3,924,666 | 12/1975 | Raison | 141/231 |

*Primary Examiner*—Richard E. Aegerter
*Assistant Examiner*—Frederick R. Schmidt
*Attorney, Agent, or Firm*—Thomas H. Whaley; Carl G. Ries; Henry C. Dearborn

[57] ABSTRACT

Apparatus for preventing an uncontrolled emission of gaseous hydrocarbons during the filling of containers, more especially tank wagons, with mineral oil products. It has an extensible fill tube so that product is discharged near the bottom of the container while vapors may be withdrawn through an annular passage surrounding the fill tube. The whole arrangement is carried on a trolley for longitudinal adjustment and there is a short lateral trolley to accommodate pivotal movement of the fill tube.

3 Claims, 3 Drawing Figures

APPARATUS FOR PREVENTING AN UNCONTROLLED EMISSION OF GASEOUS HYDROCARBONS DURING THE FILLING OF CONTAINERS

CROSS-REFERENCE TO RELATED APPLICATION

This is a continuation-in-part of copending application Ser. No. 643,898 filed Dec. 23, 1975, now abandoned.

BACKGROUND OF THE INVENTION

1. Field of the Invention

The invention relates to apparatus for preventing an uncontrolled emission of gaseous hydrocarbons during the filling of containers, particularly tank wagons or fuel tankers, with mineral oil products. It has a filling pipe around which is arranged a jacket tube whose outside diameter is smaller than the opening of the filling aperture of the container. The jacket tube defines an annular space between it and the filling pipe. The apparatus has an elastic packing between the outer wall of the jacket tube and the inner wall of the filling aperture.

2. Description of the Prior Art

The filling of a tank wagon normally takes place through a manhole which is at the top of the tank. Mineral oil products flowing in thereby displace the evaporated parts of the loaded product which is in the interior of the tank, and these evaporated constitutents emerge through the manhole and accumulate in the vicinity of the filling station. Apart from a not inconsiderable loss of the product, these quantities of hydrocarbon vapor case pollution of the environment. Heretofore, it has been proposed to use apparatus for preventing an uncontrolled emission or escape of gaseous hydrocarbons during the filling of containers, particularly tank wagons, with mineral oil products, which apparatus was characterised in that around a filling pipe there was arranged a jacket tube whose outside diameter was smaller than the opening of the filling aperture of the container. It defined an annular space between the filling pipe and the jacket tube. At the upper end of the annular space, an annular duct was provided which was sealed in relation to the filling pipe and had a suction pipe for the emerging gaseous hydrocarbons. And, it had an elastic packing arranged between the outer wall of the jacket tube and the inner wall of the filling aperture.

In practical loading operations it has, however, been found that the gas suction pipe which ran from the annular duct which was fastened to the jacket tube, was subject to disturbance. This was because for the sake of necessary mobility, it was constructed as a telescopic tube whose tolerances were very small in order to provide the necessary gas tightness. Therefore, damage easily occured during rough loading conditions. Jamming and leaks were the result.

A further disadvantage of the known apparatus consisted in that the design of the elastic packing was unequal to the high mechanical stresses occurring when the filling pipe was introduced into the manhole or the like. As tank wagons must be regarded not only from the point of view of their very variable structural shapes but also from their manufacture as coarse machine constructions, so variations in dimensions may be quite considerable. Thus, it has not always been possible to span these variations with known inflatable elastic packings. Or, least, these dimensional variations have led to high lateral stresses on the packing.

According to British Patent Specification No. 1 287 872, a filling apparatus is known which provides for the displaced vapors being drawn off through an annular space that is defined between the outer wall of the filling pipe and the inner wall of the jacket tube. It has the outer wall of the jacket tube sealed in relation to the inner wall of the manhole of the container to be filled, by having an inflatable annular beading. However, such apparatus has the disadvantage that the filling pipe or tube is not slidingly fixed in the jacket tube. Consequently, the filling pipe, when it is dipped into the tank or container which has to be filled, cannot adapt itself to the various tank dimensions so as to allow the filling pipe to rest upon the floor of the tank during the filling operation. Thus, the liquid which is being fed into the tank flows in from a relatively great height and gives rise to an electrostatic charge which may create a dangerous electrostatic potential between the fluid and tank wall.

Some old U.S. patents have dealt with the filling of beer kegs, etc., using fill tubes and having annular connection at the bunghole. However, the structures deal with maintaining pressure on the beer and they are quite complex.

Consequently, it is an object of this invention to provide apparatus of the type mentioned above, which is equal to the stresses occurring in an automatic loading operation, and which overcomes the aforementioned disadvantages.

SUMMARY OF THE INVENTION

Briefly, the invention is in combination with apparatus for filling hydrocarbon liquid containers or the like through a filling aperture therein. The apparatus has a fill pipe and a concentric outer tube for preventing uncontrolled escape of vapor from the container being filled. It also has means for sealing the outer tube into vapor-tight contact with said filling aperture. It is the improvement which comprises means for movably extending said fill pipe relative to said outer tube in order to discharge said filling liquid adjacent to the bottom of a container being filled, and conduit means associated with said outer tube for conducting said escaping vapors. It also comprises means for pivotally supporting said fill pipe near the upper end thereof for lateral adjustment of the fill pipe relative to said container, and means for longitudinally moving said pivotal supporting means and said fill pipe near the upper end thereof for lateral adjustment of the fill pipe relative to said container, and means for longitudinally moving said pivotal supporting means and said fill pipe together relative to said container.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

Figure 1:
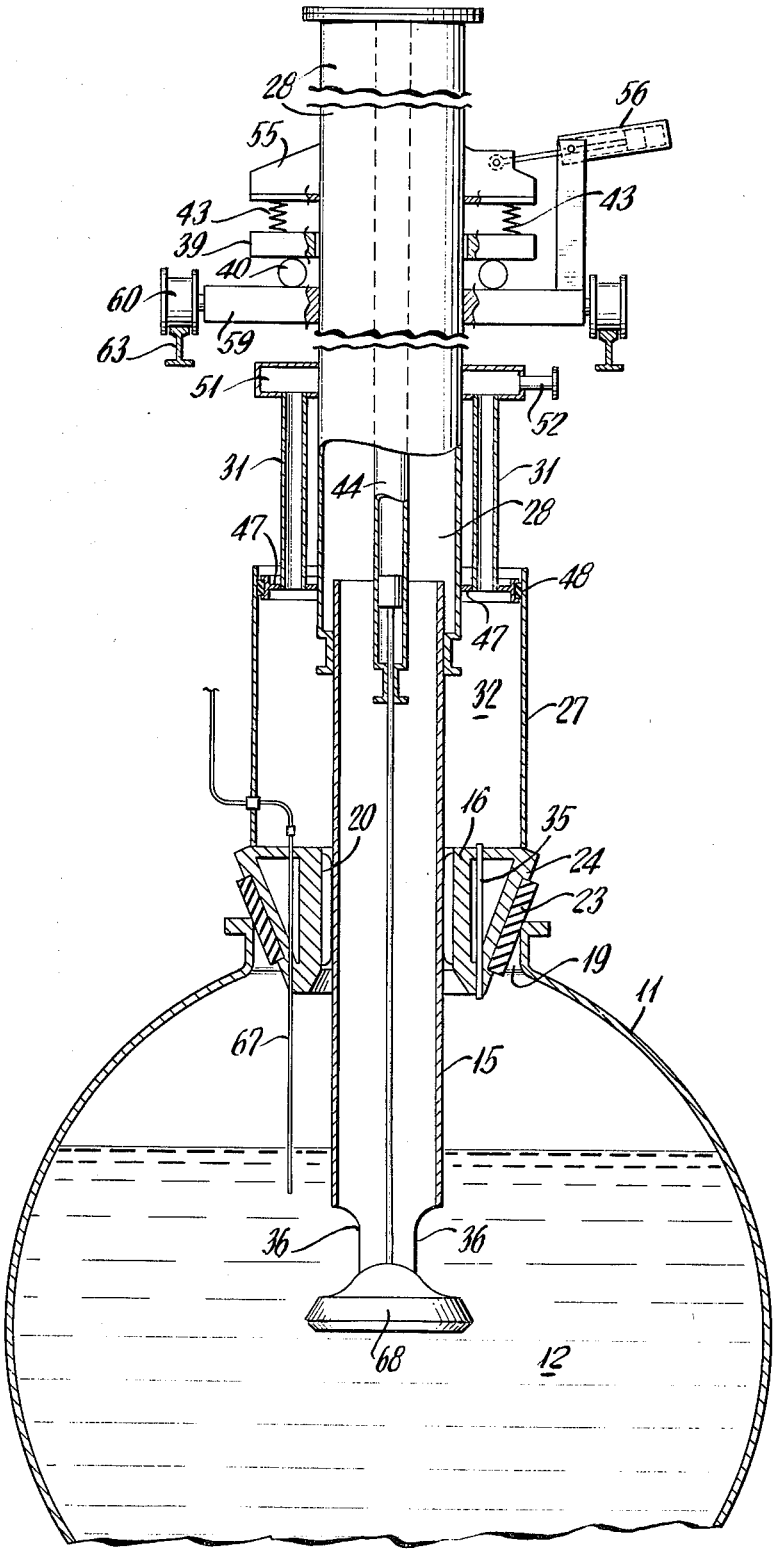
FIG. 1 is a schematic elevation, partly in cross-section, illustrating a preferred embodiment of the invention.

According to the invention there is provided apparatus which prevents an uncontrolled emission or escape of gaseous hydrocarbons during the filling of containers, more especially during the filling of tank wagons or fuel tankers with mineral oil products. Thus with reference to the drawings, there is illustrated a tank 11 which contains a mineral oil product 12. The filling apparatus includes a telescopic filling pipe 15, and around the free end thereof is arranged a sliding jacket tube 16. The jacket 16 has an outside diameter that is smaller than an opening 19 of the filling aperture of the container 11 to be filled.

There is an annular space 20 between the filling pipe 15 and the jacket tube 16. This space 20 may have longitudinal ribs therein, as illustrated, to guide and center the pipe 15 within the jacket tube 16. Also, there is an elastic packing 23 which is fixed to an outer frusto-conical wall 24 of the jacket tube 16. This arrangement closes the space in the filling aperture 19 which is not occupied by the filling pipe 15 when the pipe is in the filling position.

The invention particularly concerns an improvement relating to the ability to conduct away the gases which emerge from the tank 11 during the filling operation. As indicated in FIG. 1, there is a jacket 27 which is connected to the upper large diameter end of the slidable jacket tube 16. This jacket 27 is arranged around the telescopable end part of the filling pipe 15. Also, the entire filling pipe including a larger upper end 28 is mounted in pendulum fashion near its upper end, as will be described in greater detail below. Also, there is at least one gas outlet pipe 31 provided, which is in communication with space 32 located between the filling pipe 15 and the jacket 27. In addition, in order to conduct away fluid hydrocarbons which may possibly collect as a result of a disturbance in the intake valve, there is an overflow bore or a small overflow tube 35 provided in the jacket tube 16.

One advantage of the construction is its ability (in the event of an eccentric position of the filling pipe in relation to the filling aperture), to automatically adapt itself by lateral swinging in pendulum fashion.

A further advantage of the construction consists in that the filling pipe can be moved down as far as the floor of the tank or other container, so that the generation of an electrostatic potential is prevented.

The jacket 27 makes it possible to retract the filling pipe 15 while maintaining it fastened in a gastight manner to the top of the jacket tube 16 and to the upper part of the filling pipe 15. Also, since the gas outlet pipe 31 leads away from the upper end of the jacket 27 which is fastened to the upper part 28 of the filling pipe 15, adaptation of it to the movements of the telescopically movable part of the filling pipe is not necessary. Therefore, the use of a telescopic pipe to the gas collecting point, (which would be beset with difficult sealing problems) is avoided.

The overflow tube 35 acts in case of a malfunction during the time when the filling pipe 15 is retracted upwards and outlets 36 of the filling pipe 15 are sealed. Tube 35 makes sure that product will not rise in the inner space 32 which is defined by the jacket 27. Rather, it will be conducted away via the the overflow bore, i.e. tube 35, which is in communication with the outside.

It may be noted that the packing 23 which is elastic material is also frusto-conical in form. It preferably may contain a support (not shown) in the form of an inside-situated metal frusto-conical band with the same angle of inclination. Such a support for the elastic packing would help resist the high mechanical stresses which tend to occur during introduction of the apparatus into the manhole.

As already indicated above, the filling pipe upper end 28 is supported pivotally. There is a filling pipe trolley 39 which has rollers 40 and springs 43. As will be explained in more detail below, the filling pipe end 28 can be moved transversely relative to the longitudinal axis of the tank 11. By this means, horizontal forces which would be caused by lateral swinging of the filling pipe 15, are reduced to a minimum.

Again with reference to FIG. 1, it may be observed that there is shown situated on the upper edge of the filling aperture 19 of the tank 11 which is to be filled, the flexible packing 23 which seals the tank 11 against the outside atmosphere. Also, the lower part 15 of the filling pipe 15 and 28 is surrounded by the jacket tube 16, within which it concentrically slides. Between the outer wall of the filling pipe 15 and the inner wall of the jacket tube 16, there is formed the annular space 20 through which the gaseous hydrocarbons or the like, may escape from the tank 11 during the filling operation. In order that the latter do not escape unchecked into the atmosphere the jacket 27, which is designed as a telescopic tube, is fastened to the upper edge of the jacket tube 16 and surrounds the filling pipe 15.

The telescopable filling pipe 15 is moved by means of a hydraulic cylinder 44 which is centrally located in the upper part 28 of the filling pipe. An annular cover 47 is arranged between the outer wall of the upper part 28 of the filling pipe 15 and the inner wall of the jacket 27. The inside of this cover 47 is fastened to the outer wall of the part 28 of the filling pipe, while the outside is provided with an annular packing 48 which produces the sealing desired for the jacket 27. Connected to the cover 47, there are a plurality of rigid gas outlet pipes 31 which are arranged parallel to the part 28 of the filling pipe 15. These pipes 31 end in an annular outlet duct 51, from which the gas is conveyed in any desired manner via a conduit 52 to the gas collecting point. Thus, it will be observed that the gas outlet pipes 31 are in communication with the annular space 32 which is defined by the jacket 27 and the lower part 15 of the filling pipe 15, 28.

It will also be observed that in the jacket tube 16 there is the overflow tube 35 which prevents any product which may possibly run out in the event of a disturbance during operation, from rising unchecked in the annular space 32.

As already indicated, the part 28 of the filling pipe 15 is supported on the filling pipe trolley 39. The springs 43 are arranged between the filling pipe trolley 39 and a suspension bracket 55 that supports the part 28 of the filling pipe. In this manner, the part 28 of the filling pipe 15 and with it also the filling pipe 15 can swing or pivot, which makes automatic fitting of the flexible packing 23 to the filling aperture 19 take place. However, in order to neutralise the horizontal forces caused by the pivoting, there is a hydraulic cylinder 56 provided which can move the bracket 55 along with the filling pipe trolley 39. It will be noted that the entire filling pipe arrangement is carried by an overhead trolley unit 59 which has wheels 60 riding on rails 63.

Figure 2:
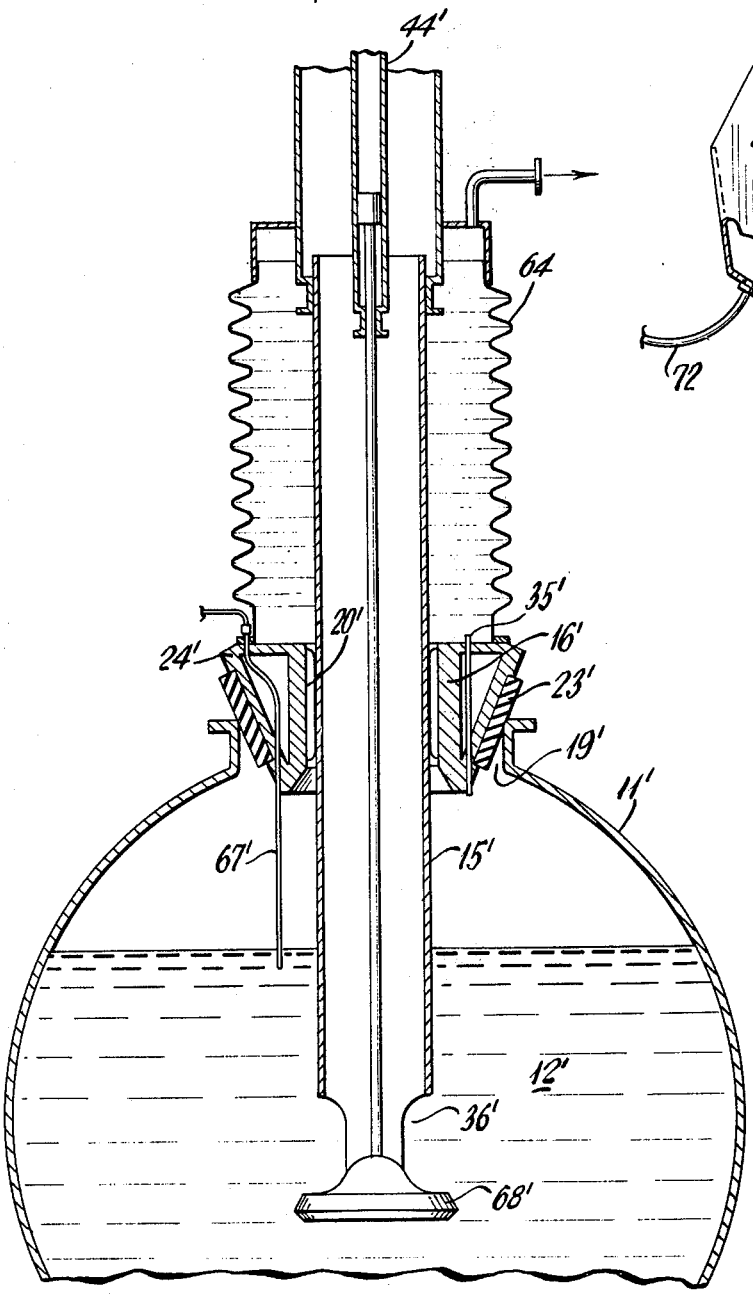
FIG. 2 is a partial view like FIG. 1, mostly in cross-section, illustrating a modification of the apparatus according to the invention.

The modified embodiment shown in FIG. 2 differs from the embodiment illustrated in FIG. 1 essentially only by the fact that there is a jacket 64 provided which has gastight concertina or bellows shaped walls. Consequently, the other elements have been designated by the same reference numbers but with a prime mark employed.

The operation may be explained with reference to a filling procedure:

When the telescopable filling pipe 15 is extended, the jacket tube section 16 will be put down on the filling aperture 19. This presses the flexible packing 23, which is fastened to it, into the opening of the aperture 19. Then, the filling pipe 15 extends further which may be as far as the floor (not shown) of the tank 11. Thereafter, the product flows into the tank 11 while the displaced gases are led away through the space 32 and the gas outlet pipes 31. There will be a conventional quantity presetting device (not shown) to limit the filling of the product. Also there may be an overfill safety device 67 which provides protection against too high a rate of filling.

Thereafter, upon upward movement i.e. retraction of the filling pipe 15, the jacket tube section 16 will be contacted when a closing plate 68 seats in the bottom of the annular space 20. Any product which still flows through the filling pipe 15 will collect in the annular space 32. Such small quantity of the product will be discharged into the next tank to be filled, during the filling operation thereof.

Figure 3:
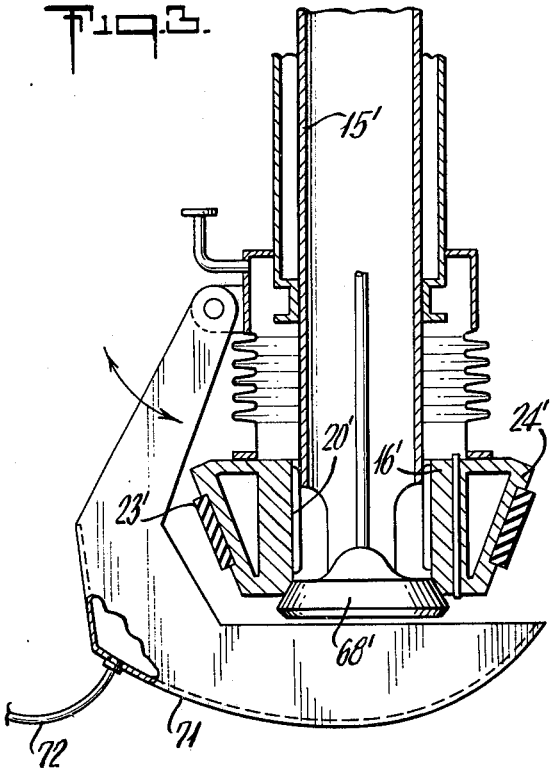
FIG. 3 is a schematic elevation, somewhat enlarged, illustrating an additional element according to the invention.

FIG. 3 schematically illustrates a pivoting cup 71 which is provided for safety reasons. This acts in the resting state of the apparatus to swing laterally underneath the filling pipe 15 and the closing plate 68. Therefore if fluid passes outwards via the overflow tube 35, it drops into this swing cup 71 and is conducted away into a slop tank (not shown) via a drain tube 72. By this means, a disturbance in operation can rapidly be recognized.

It may be noted that in the case of the type of filling operation described, there is no visual control of the filling operation by the operator. For this reason, the overfilling safety device 67, which preferably operates according to the differential pressure principle, is provided.

While particular embodiments of the invention have been described in considerable detail, in accordance with the applicable statutes, this is not to be taken as in any way limiting the invention but merely as being descriptive thereof.

We claim:

1. In combination with apparatus for filling hydrocarbon liquid containers or the like through a filling aperture therein, said apparatus having a fill pipe and a concentric outer tube for preventing uncontrolled escape of vapor from the container being filled, and having means for sealing said outer tube into vapor-tight contact with said filling aperture, the improvement comprising a hydraulic cylinder and piston situated within said fill pipe for movably extending said fill pipe relative to said outer tube in order to discharge said filling liquid adjacent to the bottom of a container being filled, conduit means associated with said outer tube for conducting said escaping vapors, means for pivotally supporting said fill pipe near the upper end thereof for lateral adjustment of the fill pipe relative to said container, means connected to said pivotal support means for neutralizing the forces caused by pivoting of said fill pipe, and means for longitudinally moving said pivotal supporting means and said fill pipe together relative to said container.

2. The invention according to claim 1, wherein the improvement also comprises a frusto-conical metallic tip on said means for sealing said outer tube, and said tip having elastic surface material on the conical surface thereof.

3. The invention according to claim 2, wherein said conduit means comprises a closure for the upper end of said outer-tube fill-pipe annulus, said closure having a plurality of conduits parallel to the axis of said fill pipe and a manifold for connecting an additional conduit to carry off said vapors.

* * * * *